US007886845B2

(12) United States Patent
King et al.

(10) Patent No.: US 7,886,845 B2
(45) Date of Patent: Feb. 15, 2011

(54) METHOD AND SYSTEM FOR MONITORING AUXILIARY OPERATIONS ON MOBILE DRILLING UNITS AND THEIR APPLICATION TO IMPROVING DRILLING UNIT EFFICIENCY

(75) Inventors: Charles H. King, Austin, TX (US); Eric E. Maidla, Sugar Land, TX (US)

(73) Assignee: Nexen Data Solutions, Inc., Sugar Land, TX (US)

( * ) Notice: Subject to any disclaimer, the term of this patent is extended or adjusted under 35 U.S.C. 154(b) by 124 days.

(21) Appl. No.: 12/017,235

(22) Filed: Jan. 21, 2008

(65) Prior Publication Data

US 2008/0289876 A1 Nov. 27, 2008

Related U.S. Application Data

(60) Provisional application No. 60/940,131, filed on May 25, 2007.

(51) Int. Cl.
*E21B 47/00* (2006.01)
*E02B 17/00* (2006.01)
*E02B 17/08* (2006.01)

(52) U.S. Cl. ..... 175/40; 405/196; 405/201

(58) Field of Classification Search ..... 175/40; 405/196, 198, 197, 195.1, 201, 203; 166/64, 166/250.01, 250.15
See application file for complete search history.

(56) References Cited

U.S. PATENT DOCUMENTS

| | | | | |
|---|---|---|---|---|
| 3,277,653 | A * | 10/1966 | Foster | 405/200 |
| 4,602,894 | A * | 7/1986 | Lorenz et al. | 405/203 |
| 4,735,526 | A * | 4/1988 | Kawagoe et al. | 405/196 |
| 4,936,710 | A * | 6/1990 | Petty et al. | 405/224 |
| 6,176,323 | B1 * | 1/2001 | Weirich et al. | 175/40 |
| 6,233,498 | B1 * | 5/2001 | King et al. | 700/174 |
| 6,390,732 | B1 * | 5/2002 | Kristensen et al. | 405/201 |
| 6,820,702 | B2 | 11/2004 | Niedermayr et al. | |
| 6,892,812 | B2 | 5/2005 | Niedermayr et al. | |
| 6,926,097 | B1 * | 8/2005 | Blake | 175/9 |
| 6,944,547 | B2 * | 9/2005 | Womer et al. | 702/7 |
| 7,401,654 | B2 * | 7/2008 | Franklin | 166/337 |
| 2003/0074391 | A1 * | 4/2003 | Carter et al. | 709/200 |
| 2005/0103491 | A1 * | 5/2005 | Newman et al. | 166/250.01 |
| 2006/0051164 | A1 * | 3/2006 | Foo et al. | 405/228 |
| 2009/0038847 | A1 * | 2/2009 | Muona et al. | 175/26 |

* cited by examiner

*Primary Examiner*—Daniel P Stephenson
*Assistant Examiner*—Michael Wills, III
(74) *Attorney, Agent, or Firm*—Richard A. Fagin

(57) ABSTRACT

A system for monitoring auxiliary operations on a drilling unit includes at least one sensor configured to measure a parameter related to a start time and a stop time of at least one auxiliary operation on the drilling unit. The system includes a data acquisition device configured to determine a start time and a stop time of the at least one auxiliary operation from measurements made by the at least one sensor. The data acquisition device includes a data recorder for recording elapsed time between the start time and the stop time.

20 Claims, 4 Drawing Sheets

EXAMPLE WELL = 1

EXAMPLE WELL = 2

METHOD AND SYSTEM FOR MONITORING AUXILIARY OPERATIONS ON MOBILE DRILLING UNITS AND THEIR APPLICATION TO IMPROVING DRILLING UNIT EFFICIENCY

CROSS-REFERENCE TO RELATED APPLICATIONS

Priority is claimed from U.S. provisional application No. 60/940,131 filed on May 25, 2007.

STATEMENT REGARDING FEDERALLY SPONSORED RESEARCH OR DEVELOPMENT

Not applicable.

BACKGROUND OF THE INVENTION

1. Field of the Invention

The invention relates generally to the field of drilling wellbores through the Earth's subsurface. More particularly, the invention relates to systems for monitoring various drilling unit operating parameters during drilling unit installation and removal procedures.

2. Background Art

The current cost of drilling operations, particularly those in marine environments, has risen dramatically in recent years. Some deep water mobile offshore drilling unit ("rig") operations cost in excess of $25,000 per hour. Such costs are making apparent the need for increased rig efficiency. Improving efficiency creates a need for measurement techniques related in particular to the time spent performing various functions on the rig. Generally, when referring to "drilling rig operations" and their related efficiency, those skilled in the art mean the time spent performing functions related to creating, deepening (lengthening) the drill hole or wellbore, and completing the wellbore. Such rig operations include, for example, rotary drilling with the drill bit "on bottom" (contacting the bottom of the wellbore) during sliding, "slide drilling" with directional drilling devices to alter the trajectory of the wellbore, tubular "tripping" (removing and inserting a pipe "string" from and into the wellbore) times, conditioning the hole and responding to downhole conditions. Efforts are often focused on measuring and improving the foregoing operations to obtain efficiency gains. For the sake of convenience the foregoing will be referred to as "drilling times."

Recent automatic technology has allowed for drilling times to be characterized automatically and analyzed using sensors and software programs to determine the rig's actual operation at any moment in time. Recent examples of such automated monitoring technology are described in U.S. Pat. Nos. 6,892,812 and 6,820,702. The systems and method described in the foregoing patents relate to the automatic detection and measurement of times when the rig is conducting drilling operations, primarily as explained above.

Time when rig functions are characterized as "non-drilling" or "Flat Times" include such mobile drilling unit functions as mooring the rig, jacking up the rig, preloading/ballasting, skidding the drilling package, nippling up/testing BOP's (blowout preventers), running and testing marine drilling riser, testing the choke and kill lines, installing the slip joint and diverter, slip and cut drill line, setting back the top drive and rigging up to cement casing as well as non drilling times such as during well completion operations. The foregoing are not currently being automatically detected, measured, and analyzed as described in the above patents specifically because they relate to operations other than drilling.

Non-drilling times are usually harder to measure due to lack of sensors and automatic detection technology to facilitate measurement. Additionally, the lack of easily identified and measured "start/stop" points of a particular non drilling time function hampers measurement. Non-drilling times durations are often bundled together with several other "non-drilling" events and captured in a lump time on the daily report of drilling activity, for example, "Rig up & run casing, cement same, install wellhead and nipple up BOP's". Such aggregated times often do not reflect the time spent performing individual activities, making it difficult to identify and measure inefficiencies and take action to correct such inefficiencies.

These non-drilling times are significant, for example, non-drilling time in a floating drilling platform can make up more than half of the total time included in drilling and completing a wellbore. Jackup drilling units, bottom supported ("platform") drilling units and land-based drilling units use smaller amounts of such non-drilling times than do floating drilling platforms but all the foregoing still experience significant non-drilling times.

Significant rig time savings of these non drilling times were obtained when efficiency efforts including dedicated personnel went to the drilling unit with the goal of improving rig efficiency. Techniques used included manual characterization and analysis of the non-drilling times, and proposed modification of rig operations to correct inefficiencies. Efficiency improvements have been achieved with the foregoing manual method, wherein one-third improvement in non drilling times was common and some improvements of more than half have been recorded. As a practical matter, once the efficiency personnel left the drilling unit and no longer manually recorded start and stop times of the non-drilling operations, the efficiency gains typically dissipated, as personnel on the drilling unit had no device by which to measure and optimize the non-drilling operations times and the operations revert to their normal routine.

There continues to be a need to automatically measure, characterize and display for analysis the amounts of time spent on various non-drilling activities on drilling units especially offshore drilling units

SUMMARY OF THE INVENTION

A system for monitoring auxiliary operations on a drilling unit according to one aspect of the invention includes at least one sensor configured to measure a parameter related to a start time and a stop time of at least one auxiliary operation on the drilling unit. The system includes a data acquisition device configured to determine a start time and a stop time of the at least one auxiliary operation from measurements made by the at least one sensor. The data acquisition device includes a data recorder for recording elapsed time between the start time and the stop time.

A method for determining auxiliary operating time on a drilling unit according to another aspect of the invention includes measuring at least one parameter related to a start time and a stop time of at least one auxiliary operation. The auxiliary operation is characterized based on at least one of the start time, the stop time and the parameter measured. An elapsed time is determined from the measurements of the at least one parameter. The elapsed time is displayed and/or recorded.

Other aspects and advantages of the invention will be apparent from the following description and the appended claims.

DETAILED DESCRIPTION

The invention will be described below first with reference to certain types of "bottom supported" mobile offshore drilling units. Later examples will be described in terms of mobile offshore drilling units that include a floating structure or platform that supports a drilling rig and associated equipment. Accordingly, it is to be clearly understood that the scope of the invention is not limited to particular types of drilling units. The principles of the invention are equally applicable to any type of drilling unit that is movable from one drilling location to another, including "platform" rigs (rigs that are disposed on a fixed-position, water bottom supported structure) and requires certain acts to be performed to prepare the unit for drilling and for moving to a different drilling location.

Figure 1:
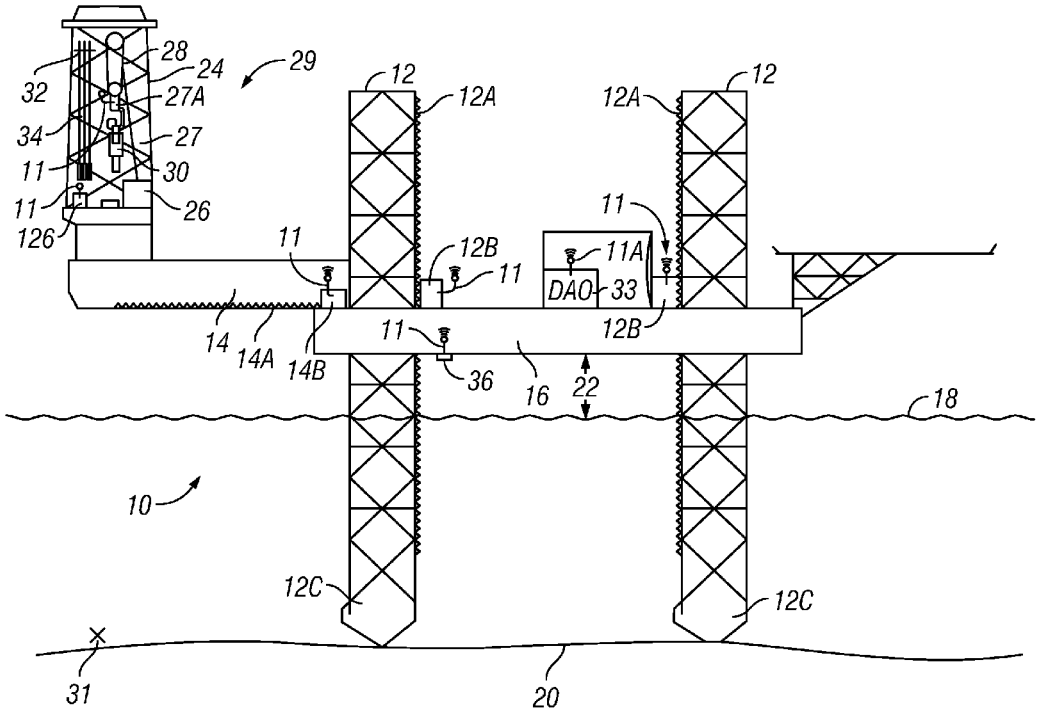
FIG. 1 shows an example mobile drilling unit and placement of sensors on the unit that are used in connection with a system and method according to the invention.

An example mobile offshore drilling unit is shown in FIG. 1 at 10. The drilling unit 10 in the present example is called a "jackup" drilling unit. Such drilling units are supported at the water bottom 20 by legs 12 that can be moved along their longitudinal direction with respect to a hull 16 of the drilling unit by operating jacking motors 12B. The jacking motors 12B each turn a respective gear unit (not shown) the output of which is in contact with a rack 12A or similar linear gear-toothed structure. Other types of jackup drilling rigs may use a pinhole/hydraulic jacking system to move the legs, for example. The legs 12 each include a "spud can" 12C at a bottom end thereof for contacting the water bottom 20 and supporting the weight of the drilling unit 10. During set up of the drilling unit 10 on a well location, the hull 16 floats and is moved in to the selected location by tug boats or similar towing vessels as the legs 12 are maintained substantially in their uppermost position with respect to the hull 16.

When the unit 10 is disposed at the selected location, the hull 16 is positioned both geodetically and with the hull 16 in a preferred geodetic orientation. The legs 12 are moved longitudinally (called "jacking") using the jacking motors 12B (or hydraulic motors in hydraulically jacked leg examples). Downward movement of the legs 12 with respect to the hull 16 eventually causes the spud cans 12C to contact the water bottom 20. When the spud cans 12C contact the water bottom 20, continued jacking of the legs 12 causes the hull 16 to move upwardly out of the water. The jacking continues until the hull 16 is positioned at a selected height ("air gap") 22 above the mean water surface 18.

When the selected air gap 22 is obtained, a cantilever structure ("cantilever") 14 may be laterally displaced from its transport position generally over the hull 16. Such lateral displacement, called "skidding out" the cantilever 14, can be performed by a cantilever skid motor 14B that rotates a gear (not shown) in contact with a cantilever skid rack 14A. Other examples of a cantilever may use a pinhole/hydraulic skidding unit in contact with the cantilever skid rack 14A. The skid out continues until a drilling rig 29, supported generally near the outward end of the cantilever 14, is positioned over a proposed well location 31 on the water bottom 20. The drilling rig 29 may include pipe lifting, supporting and rotating devices familiar to those skilled in the art, for example, a derrick 24 in which is included a tubular or pipe rack 32 to vertically support assembled "stands" of tubulars 34 used in wellbore drilling, testing and completion operations. The rig 29 may include a winch called a drawworks 26 that spools and unspools wire rope or cable, called "drill line" 27, for raising and lowering a traveling block and hook 28. The hook 28 may support a top drive 30 or similar device for applying rotational energy to the pipe for various drilling and well completion operations.

In the present example, sensors may be associated with some of the foregoing drilling unit components to measure one or more parameters used in various aspects of the invention. The parameters measured by the various sensors described herein may be characterized as being related to the beginning and the end of one or more "auxiliary operations." As used in the present description, the term "auxiliary operations" is intended to mean any function or operation on the drilling unit 10 that is not related to equipment or devices being inserted into or removed from a wellbore (including the active drilling of such wellbore), but is nonetheless essential to enabling the drilling unit 10 to perform intended drilling operations. The above examples of jacking the legs 12 until the selected air gap 22 is obtained, as well as skidding the cantilever 14 are two of such auxiliary operations. Other examples of auxiliary operations and their use in a method according to the invention will be further explained below.

As an example, each jacking motor 12B may include a sensor and an associated wireless data transceiver (shown at 11 collectively) for measuring electric current drawn by the respective jacking motor 12B. A similar wireless transceiver/sensor combination 11 may be associated with the cantilever skid motor 14B. A transponder, such as an acoustic or laser range finder, or a global positioning system receiver, shown at 36, may be disposed proximate a bottom surface of the hull 16 in order to measure the air gap 22. Such sensor 36 may also include an associated wireless transceiver 11. A data acquisition system ("DAQ") 33 may be disposed at a convenient position on the drilling unit 10 and include a wireless transceiver 11A for receiving data from the various sensors, such as those described above. Although in the present example the various sensors include wireless transceivers 11 to communicate with the DAQ 33, it should be clearly understood that "wired" sensors may also be used in accordance with the invention.

The drilling rig 29 may also include sensors for measuring various parameters related to operation of the drilling rig 29. An example of such sensors and methods for validating and interpreting the measurements made by the rig sensors to automatically determine what drilling operation is underway at any time are described in U.S. Pat. No. 6,892,812 issued to Niedermayr et al. and incorporated herein by reference. As shown in FIG. 1, one such sensor is can be a load cell 27A arranged to determine the total axial force (weight) supported by the drilling unit 29. The load cell 27A may be coupled wirelessly through a transceiver 11 to the DAQ 33. Such load cell is generally known in the art as a "weight indicator." Another sensor may be a pressure/volume sensor 126 associated with pumps (not shown) configured to move fluid through appropriate rotary seals in the top drive 30 and into any pipe coupled to the top drive, such as a drill string or casing. The pressure/volume sensor 126 may include a pressure transducer (not shown separately) and a device known in the art as a "stroke counter" or similar device that measures a parameter related to the volume displacement of pistons within cylinders in a "mud pump." The pressure volume sensor 126 may also be wirelessly coupled to the DAQ 33. The weight indicator (load cell 27A) and the pressure/volume sensor 126 may be used to make measurements related to the start and stop times of various operations as will be described below in more detail.

Having described an example drilling unit and examples of sensors for measuring parameters related to start and stop times of auxiliary operations, a more complete description of an example method using measurements from such sensors to characterize and display elapsed times for auxiliary operations will now be explained.

For a jackup drilling unit such as shown in FIG. 1, auxiliary operations performed prior to starting drilling of a wellbore are typically performed in a certain sequence. An example of such a sequence would include the following.

TABLE 1

1. Drilling unit is moved to selected location.
2. Drilling location is surveyed for positional accuracy and for presence of subsurface and water bottom hazards.
3. Hull is moved to five foot (1.6 meter) air gap.
4. The "water tower" is rigged up.
5. Preload is pumped.
6. Preload is discharged ("dumped").
7. The hull is lifted to its final selected air gap.
8. Transportation securing devices are unlocked from the cantilever
9. The cantilever is skidded to its selected lateral position. Drilling fluid, air and hydraulic hoses, and electrical cable are connected between the drilling rig and equipment disposed in the hull.
10. Ropes are installed and equipment disposed on a supply vessel is unloaded.
11. A percussion hammer used to install "drive pipe" in the water bottom is inspected and serviced.
12. The hammer and "drive pipe" are lifted into position for installation by the drilling rig.
13. The drive pipe installation by the hammer is initiated.

Of the above listed auxiliary operations, certain ones may be described as "critical path" operations because they must be performed in a particular sequence in order for the drilling unit 10 to be capable of commencing drilling operations. The other auxiliary operations may be referred to as "off critical path" because they may be done concurrently with certain other operations (auxiliary and/or drilling) and/or out of sequence to some extent. The critical path and off critical path operations from the above example, and additional off critical path operations typically performed during set up of the drilling unit may include the following:

TABLE 2

| Critical Path Operations | Off Critical Path Operations |
|---|---|
| Move unit onto location | Rig up water tower; remove flanges |
| Jack to 5 foot air gap | Survey location; grease legs |
| Pump preload | Service hammer |
| Dump preload | Release cantilever transportation locks |
| Jack to final air gap | Grease cantilever skid out equipment |
| Skid cantilever | Offload equipment on vessel |
| Lift hammer and drive pipe | |
| Install drive pipe | |

In the present example, the various sensors described with reference to FIG. 1 may be interrogated at selected intervals automatically by the DAQ (33 in FIG. 1). The DAQ 33 may include a programmable microprocessor (not shown separately) or similar programmable computing device capable of executing program instructions. The program instructions may be preloaded onto the processor or may be stored in a computer readable medium for loading at the system operator's convenience.

Figure 2:
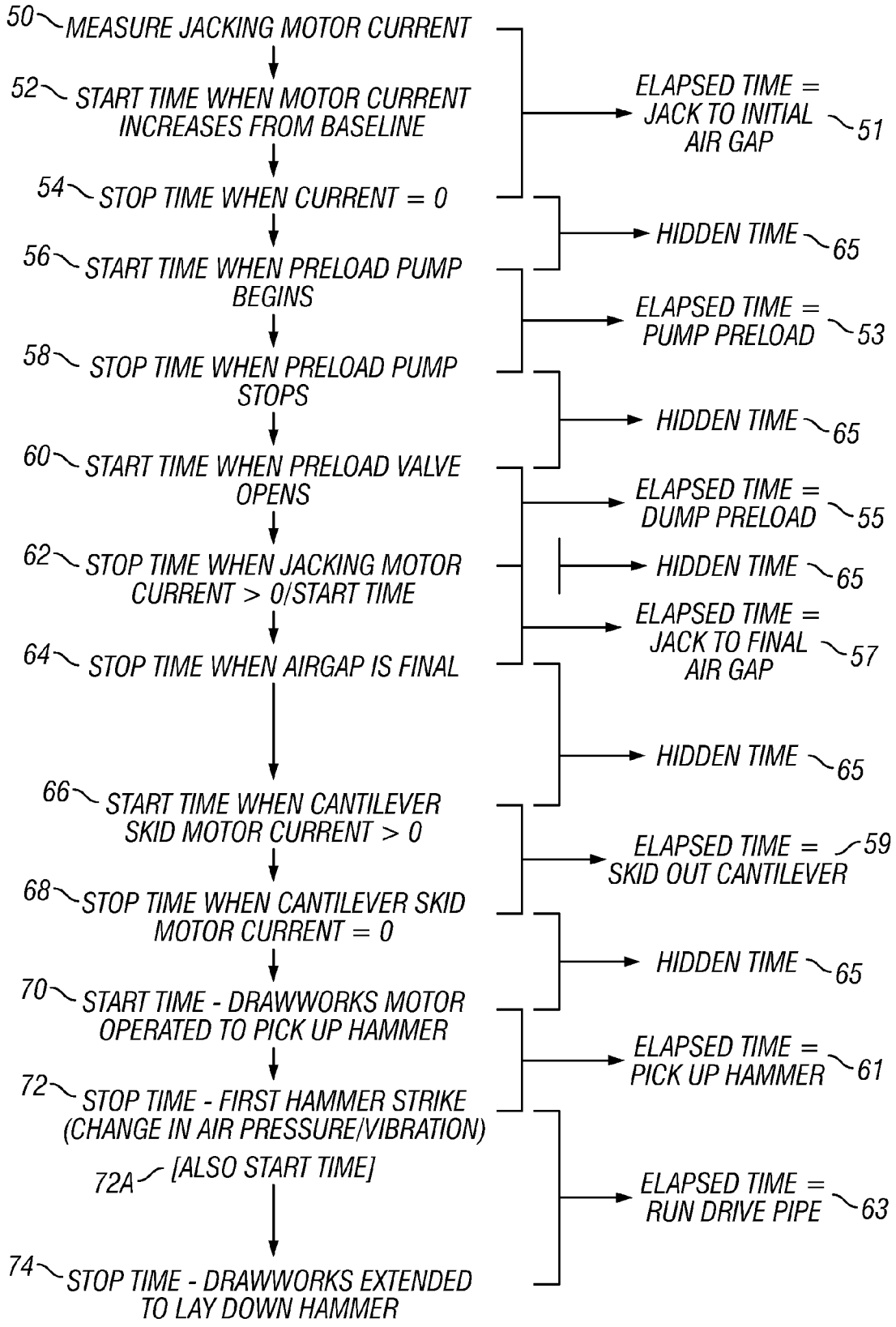
FIG. 2 shows an example time recoding sequence for various drilling unit operations.

An example of elapsed time recording and characterization within the DAQ is shown in a flow chart in FIG. 2. Upon arrival of the drilling unit (10 in FIG. 1) at the location, the DAQ may be initialized. At 50, current drawn by the jacking motors (12B in FIG. 1) is measured, using sensors as explained above. The DAQ may be programmed to begin recording time when the motor current increases over an amount associated with the legs moving through the water, as shown at 52. Such current amount may be associated with the legs contacting the water bottom so as to begin lifting the hull. The recording time may be stopped when the jacking motor current returns to zero, at 54. The elapsed time measured between the above start and stop times may be characterized as the amount of time performing the "jack to initial air gap" critical path operation, as shown at 51.

The DAQ may be programmed to query the various sensors on the drilling unit, and determine a start time for pumping preload from the measurements made by certain of the sensors. For example, a pump used to pump preload (not shown in the figures) may have its current measured. When the pump current is switched on as measured by the associated sensor, the DAQ may be programmed to begin recording elapsed time, as shown at 56. When the pump current is switched off, recording of elapsed time may stop, as shown at 58. Elapsed time recorded by the DAQ may be characterized as the "pump preload" critical path operation, as shown at 53.

A valve (not shown) used to dump preload may include a position sensor to determine when the valve is open or closed. The DAQ may be programmed to start recording time, at 58, when the preload valve is opened. The recording may be stopped, at 60, when the jacking motor current is greater than zero, shown at 62, indicating that the preload has been dumped sufficiently to enable jacking the hull to the final air gap. The foregoing elapsed time may be characterized as the "dump preload" critical path operation, as shown at 55. Concurrently with the stop time of the "dump preload" operation, the DAQ may be programmed to initialize elapsed time for the "jack to final air gap" operation when the jacking motor current is switched on. The stop time of the jack to final air gap operation may be triggered in the DAQ by, for example, when the jacking motor current is switched off, or when the sensor (36 in FIG. 1) detects that the selected air gap has been obtained.

When the skid motor current is detected as having been switched on, at 66, the DAQ may be programmed to begin recording elapsed time. The recording may be stopped when the skid motor current is switched off, at 68. The recorded elapsed time, at 59, may be characterized in the DAQ as for the "skid out cantilever" operation, at 59.

At 70, current for a motor used to operate the drawworks (26 in FIG. 1) may be measured. When the current is switched on, the DAQ may begin recording elapsed time. Recording may be stopped when a first hammer strike is detected. Such strike detection may be obtained by measuring, for example, air or hydraulic pressure used to operate various components on the rig (29 in FIG. 1) or by including a vibration sensor (not shown) in the pneumatic or hydraulic power unit of the hammer. The recorded elapsed time may be characterized in the DAQ as the operation "pick up hammer" at 61. Concurrently with detection of the first hammer strike at 72A, the DAQ may be programmed to begin recording elapsed time until, for example, drawworks motor current measurements or hook-load indications correspond to having laid the hammer down out of the rig, as shown at 74. The elapsed time may be characterized in the DAQ as the operation "run drive pipe."

In the present example, the DAQ may be programmed so that notwithstanding measurements made by the various sensors as being indicative of a start or stop time of a particular operation, the determined start and stop times of certain auxiliary operations must take place in a predefined sequence. By programming the DAQ to determine start times and stop times of certain events in a predefined sequence, and thus to record elapsed times in a predefined sequence, the possibility of false time recording (time allocated to an operation not consistent with the actual operation underway) will be reduced. An example of such a predefined sequence includes the events shown in their respective order in Table 1. Sensor measurements made by the various sensors may be used to determine start time of a particular operation only when all prior operations in the predefined sequence have been determined to be completed.

The time recording programming instructions for the DAQ may also include recording elapsed time between the end or stop time of one of the above operations and the start time (where not concurrent therewith) of the succeeding operation in the predefined sequence. Such times are shown in FIG. 2 as "hidden times" 65, and in some cases such hidden times may be associated with activities on the drilling unit that require human activity or require intervention by personnel on the drilling unit. The hidden times 65 each may be further characterized with respect to the two operations that are adjacent thereto in the drilling unit set up sequence (the predefined sequence for programming the DAQ).

Figure 3:
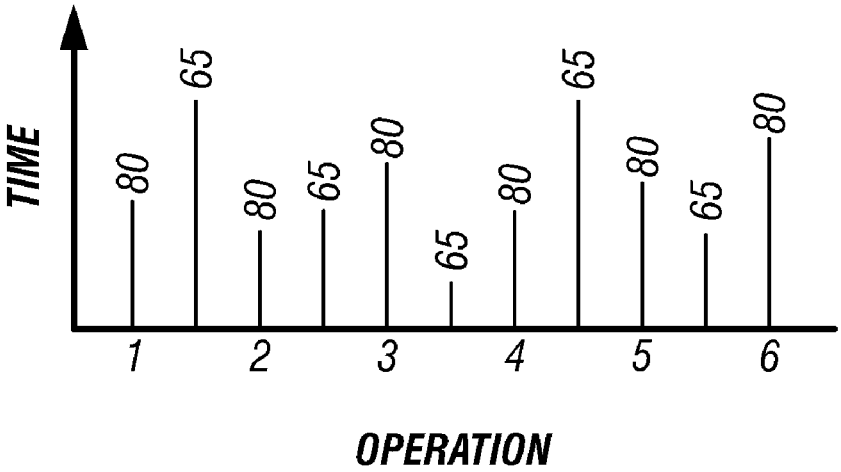
FIG. 3 shows an example data display of recorded times according to an example data recording sequence.
Figure 3:
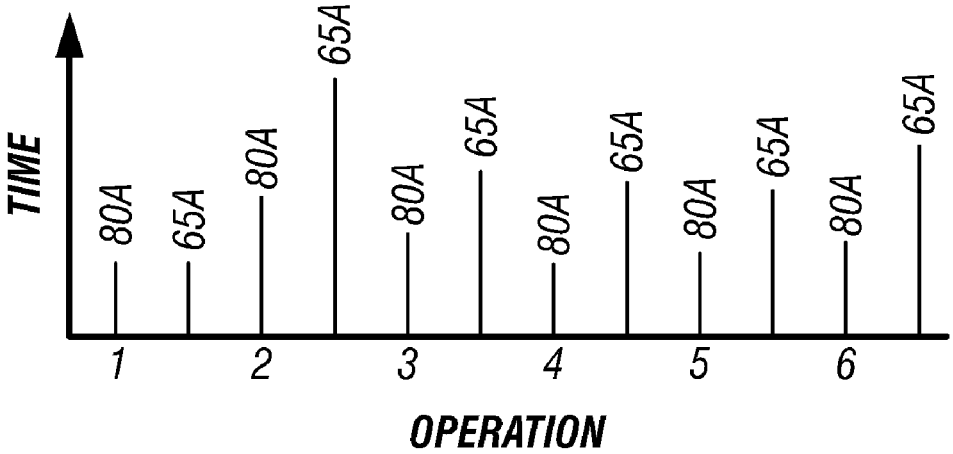

Time recordings made and characterized as explained above may be displayed in various formats for evaluation by the system operator. The time recording display may be made on any suitable computer display, including a cathode ray tube or liquid crystal display, a printer, or any similar display device. An example display format is shown in FIG. 3. The upper bar graph in FIG. 3 may represent elapsed times recorded for various operations described above. The size of each bar 80 may represent time for each of the operations (1 through 6) on the coordinate axis of the graph. The hidden times between successive operations may be displayed on the same or a different graph. In FIG. 3, the hidden times are shown at 65. The upper bar graph may represent, for example, operations conducted on a first well in a particular operating area. A lower graph in FIG. 3 may represent corresponding operations for a different well in the same or a different operating area. The operating times are shown at 80A and the hidden times are shown at 65A in FIG. 3 for such subsequent well.

The system operator may use the displayed times to evaluate a number of different performance criteria. For example, the hidden times may be used to evaluate the efficiency of different personnel on the drilling unit. The operating times may be used to evaluate whether the equipment associated with each particular operation is functioning properly, and/or whether the particular personnel operating such equipment are doing so correctly and/or efficiently.

Having explained an example of the invention used on a bottom supported drilling unit backup), an example implementation of the invention on a floating drilling structure follows.

One procedure on a floating drilling structure is "Mooring/Anchoring up." Such procedure includes deployment of mooring lines to a device that fixes their position with respect to the water bottom so that the floating drilling structure will remain substantially fixed during drilling operations. Measurements made for such time interval includes the time to moor up each individual mooring line and the efficiency of each of the Anchor Handling Vessels ("AHV"). Such time interval may be measured, for example, beginning when an AHV begins to pull on is respective mooring line. A record of the tension exerted on a tension measuring device associated with the mooring line maybe used to start and stop recording the mooring line deployment time. The time period may end when the AHV releases the mooring, and tension is released as indicated by the mooring line tension indicator.

Another measurement associated with a floating drilling unit is the AHV switching/hookup & tensioning efficiency. The time interval measured may be that needed for the AHV to reposition and rig up onto another mooring. Such time period may begin when the mooring tension is released from the previous mooring, as indicated by the tension indicator. The time period may end when tensioning begins on the subsequent mooring as indicated by the tension indicator. A total time for setting and testing all anchor may be recorded from the above time periods.

The time required to tension the moorings to the required tension after setting all moorings may also be recorded. Such time may be the sum of the individual mooring line times as explained above, the switching/hookup times and bringing moorings to final required tensions. Such time interval may begin when the AHV begins to tension the first mooring and may end when final tensions on all moorings are completed.

Another time interval that may be measured includes an AHV retrieval wire line speed. Such interval may includes the time required to retrieve the AHVs retrieval wire after setting the anchor so as to begin the next anchor deployment and setting. The interval may begin when the anchor is on bottom and the floating drilling platform begins to tension up on the mooring line. The interval may end when the AHV is connected to subsequent mooring and begins apply tension on the next mooring as indicated by the mooring tensioning device.

Other examples of floating drilling platform procedures and time interval measurements may be found in the table below.

TABLE 3

| Procedure | Purpose | Interval Start Event | Interval Stop Event |
|---|---|---|---|
| Blowout preventer ("BOP") Running Times | Measure the time required to connect the multiplex lines, slope indicators and installing the first joint of riser | Skid out BOP cart as indicated by BOP cart skidding motor current or hydraulic pressure | BOP is lifted off the BOP cart with the first joint riser as indicated by rig's weight indicator or load sensor on the Riser Spider |

TABLE 3-continued

| Procedure | Purpose | Interval Start Event | Interval Stop Event |
|---|---|---|---|
| Riser running and connection times | Measures the time to pick up and add a joint of riser to the riser string as indicated by the time the riser is landed on the riser spider. | When riser joint is picked up as indicated by the rig's weight indicator or load sensor on the Riser Spider | When the riser string with the new riser joint added is picked as indicated by the drilling rig's weight indicator |
| Choke and Kill line ("C&K") testing times | Measure the amount of time required to fill the C&K lines, booster line and install the test cap, and test the lines. | When the riser is in riser spider as indicated by the drilling rig weight indicator or load sensor on the Riser Spider | When test pump pressure indicates a steady test pressure on the C&K lines |
| Pick up and Install Slip Joint | Measure the time to pick up and install the slip joint in the riser string | When riser string is set in riser spider as indicated by the drilling rig weight indicator or load sensor on the Riser Spider | When the slip joint is picked up, (different weight of typical riser joint) installed in string then riser string with slip joint is picked up as indicated by the drilling rig weight indicator or load sensor on the Riser Spider. |
| From start testing to finish testing BOP equipment (BOPE) | Measures the time to begin testing BOPE to finish testing BOP, C&K lines, Choke manifold, and inside BOPs | Start testing BOP as indicated by the BOP control panel, cement pump and test chart | When BOPE test complete and drill pipe test string is tripped out of hole and set back as indicated by weight indicator |

Figure 4:
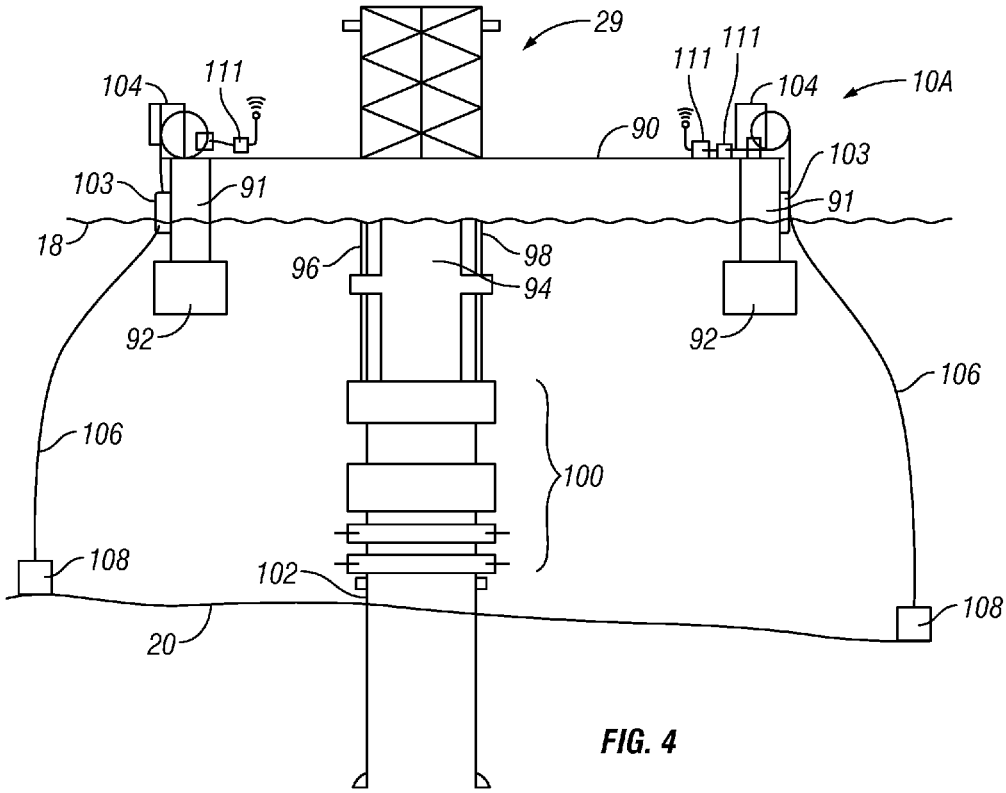
FIG. 4 shows an example of a floating mobile drilling unit that may be used with other examples of a system and method according to the invention.

An example floating mobile offshore drilling unit is shown in FIG. 4 at 10A. The unit 10A shown in FIG. 4 is known as a "semisubmersible" drilling unit. The following description is equally applicable to other types of floating drilling units, such as drill ships. The unit 10A includes a drilling deck 90 that may be supported above the surface of the water 18 by floatation devices such as pontoons 92. The drilling deck 90 is coupled to the pontoons 92 by columns 91 such that when the pontoons 92 are submerged to a selected depth below the water surface 18, the drilling deck is supported at a selected height above the water surface 18. The type of floating drilling unit shown in FIG. 4 is also known as a "moored" unit, in that the geodetic position of the unit is maintained by a mooring system. The mooring system includes winches 104 that retrievably deploy mooring lines 106 through fairleads 103 to anchors 108 fixed on the water bottom 20.

In the example shown in FIG. 4, the winches 104 may each include a motor current sensor, hydraulic pressure sensor or other device, shown generally at 111, that detects operation of the respective winches 104. Output from the winch sensors 111 may be wirelessly (see 11) communicated to the DAQ (see 33 in FIG. 1). The drilling deck 90 may support a drilling rig 29. The drilling rig 29 may be configured substantially as explained with reference to FIG. 1. For purposes of the invention, sensors and equipment associated with the drilling rig 29 will be substantially the same irrespective of whether the drilling unit is a floating structure as in FIG. 4, or is a bottom supported structure as shown in FIG. 1. Floating drilling units typically provide that a marine riser 94 is coupled between the unit 10A and a subsea BOP stack 100. The BOP stack is typically coupled to the upper end of a surface casing 102 placed in the well immediately below the water bottom 20. Various operations related to assembling the marine riser 94 and BOP 100, including testing choke and kill lines 96 and multiplex cables 98 are explained above. Testing the BOP 100 is typically performed on a suitable fixture (called a "stump"—not shown) disposed on the drilling deck 90.

Although not shown separately in FIG. 4, those skilled in the art will appreciate that the drilling rig 29 in FIG. 4 may include similar equipment and sensors as the drilling rig shown in FIG. 1. Accordingly, certain operations for which start and stop times make use of measurements made by the various sensors associated with the drilling rig 29 are equally applicable to both the bottom supported drilling unit shown in FIG. 1 and the floating drilling unit shown in FIG. 4.

It is also within the scope of the present invention to measure start and stop times of certain activities related to completion of a wellbore. "Completion" of a wellbore is generally understood to mean placing a pipe or casing in the well and installing particular equipment used to move fluids, or assist in such motion, from within a subsurface Earth formation to the Earth's surface. Examples of completion related actions and their corresponding time intervals may include the following:

TABLE 4

| Procedure | Purpose | Interval Start Event | Interval Stop Event |
|---|---|---|---|
| Rig up and install tubing head assembly | Time to rig up to pull corrosion cap, rig up and install tubing | Pull protective corrosion cap, install tubing head assembly | Pick up the Blowout Preventers (BOP) from the test stump as |

TABLE 4-continued

| Procedure | Purpose | Interval Start Event | Interval Stop Event |
|---|---|---|---|
| | head time | as indicated by hydraulic release pressure | indicated by hydraulic release pressure and rig's weight indicator. |
| Run and test BOPs | Measure and evaluate time needed to run and test BOP equipment | Pick up the BOP from the test stump as indicated by hydraulic release pressure and rig's weight indicator | Finish testing BOPs as indicated by cement pump steady pump pressure and test chart |
| Pressure & function Test Subsea Tree on test stump | Test Subsea Tree just prior to running to sea floor | Start pressure and function test as indicated by cement or Subsea Tree control panel | When function test and pressure tests are complete as indicated by cement pump and test chart |
| Skid Subsea Tree to moonpool & rig up to run | Skid the Subsea Tree to the moonpool in anticipation of running to seafloor | When function test and pressure tests are complete as indicated by cement pump and test chart | When rig up is complete and Subsea Tree is picked up off the test cart as indicated by weight indicator |

It should be clearly understood that the present invention is not limited to the particular procedures and time intervals in the above examples. The above examples are meant only to illustrate the principle of the invention and how the invention may be used to improve the efficiency with which a drilling unit operates, particularly as such efficiency relates to auxiliary operations.

A drilling unit using a system and methods according to the various aspects of the invention may provide improved efficiency with respect to auxiliary operations than drilling units that do not use such system and methods. A system and methods according to the invention may provide operators of such drilling units with diagnostic capability to determine sources of inefficiency in auxiliary operations and suggest corrective action or actions to improve efficiency.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A system for monitoring auxiliary operations on a drilling unit, comprising:

at least one sensor configured to measure a parameter related to a start time and a stop time of at least one auxiliary operation on the drilling unit;

a data acquisition device configured to determine a start time and a stop time of the at least one auxiliary operation from measurements made by the at least one sensor, the data acquisition device including a data recorder for recording elapsed time between the start time and the stop time, the acquisition device configured to determine start and stop times of the at least one auxiliary operation in response to the measurements only within a predetermined sequence of additional auxiliary operations.

2. The system of claim 1 wherein the at least one sensor comprises a current sensor configured to measure current drawn by a jacking motor on a jackup drilling unit.

3. The system of claim 1 wherein the at least one sensor comprises a current sensor configured to measure cantilever skid out motor current on a jackup drilling unit.

4. The system of claim 1 wherein the at least one sensor is configured to measure a parameter related to an air gap below a hull of a jackup drilling unit.

5. The system of claim 1 wherein the data acquisition device includes a display configured to display the recorded elapsed time.

6. The system of claim 1 wherein the data acquisition device is configured to record an elapsed time between the stop time of the at least one auxiliary operation and a start time of a succeeding auxiliary operation.

7. The system of claim 6 further comprising means for comparing the elapsed time recorded between corresponding operations on different wells.

8. A method for determining auxiliary operating time on a drilling unit, comprising:

measuring at least one physical parameter related to a start time and a stop time of at least one auxiliary operation using a sensor deployed on the drilling unit, the sensor generating a signal corresponding to the physical parameter;

conducting the signals to a processor configured to perform the act of characterizing the auxiliary operation based on at least one of the start time, the stop time and the physical parameter measured, the characterizing based on occurrence of a predetermined sequence additional auxiliary operations;

determining an elapsed time from the measurements of the at least one parameter in the processor; and at least one of storing and displaying the elapsed time.

9. The method of claim 8 wherein the parameter comprises jacking motor current on a jackup drilling unit.

10. The method of claim 8 wherein the parameter comprises cantilever skid motor current on a jackup drilling unit.

11. The method of claim 8 wherein the parameter comprises air gap of a hull of a jackup drilling unit.

12. The method of claim 8 further comprising measuring and recording an elapsed time between the stop time of the auxiliary operation and a start time of a subsequent auxiliary operation.

13. The method of claim 12 further comprising comparing the elapsed time recorded between corresponding operations on different wells.

14. The method of claim 8 wherein the auxiliary operation comprises jacking to an initial air gap.

15. The method of claim 8 wherein the auxiliary operation comprises pumping preload.

16. The method of claim 8 wherein the auxiliary operation comprises dumping preload.

17. The method of claim 8 wherein the auxiliary operation comprises jacking to a final air gap.

18. The method of claim 8 wherein the auxiliary operation comprises skidding out a cantilever.

19. The method of claim 8 wherein the auxiliary operation comprises tensioning a mooring line.

20. The method of claim 8 wherein the auxiliary operation comprises testing blowout preventer equipment.

* * * * *